United States Patent [19]

Wolff

[11] Patent Number: 4,683,379

[45] Date of Patent: Jul. 28, 1987

[54] LAMP FOR EMISSION OF RADIATION IN UV AND VISIBLE LIGHT RANGES OF THE SPECTRUM

[76] Inventor: Friedrich Wolff, Störklingasse 38, CH-4125 Riehen/Basel, Switzerland

[21] Appl. No.: 770,723

[22] Filed: Aug. 29, 1985

[30] Foreign Application Priority Data

Aug. 29, 1984 [DE] Fed. Rep. of Germany ..... 3431692

[51] Int. Cl.[4] ..... G21G 4/00

[52] U.S. Cl. ..... 250/493.1; 250/503.1; 250/504 R; 313/112; 313/486; 313/487; 252/301.4 R

[58] Field of Search ..... 250/493.1, 503.1, 504; 313/112, 486–487; 252/301.4 R

[56] References Cited

U.S. PATENT DOCUMENTS

| | | | |
|---|---|---|---|
| 3,657,141 | 4/1972 | Chenot | 252/301.4 R |
| 3,836,477 | 9/1974 | Lagos | 252/301.4 R |
| 3,992,646 | 11/1976 | Corth | 313/487 |
| 4,007,394 | 12/1977 | Rabatih | 313/486 |
| 4,095,113 | 6/1978 | Wolff | 250/504 |
| 4,106,083 | 8/1978 | Wolff . | |
| 4,177,384 | 12/1979 | Wolff . | |
| 4,194,125 | 3/1980 | Wolff . | |
| 4,196,354 | 4/1980 | Wolff . | |
| 4,251,750 | 2/1981 | Gallien et al. | 313/487 |
| 4,287,554 | 9/1981 | Wolff . | |
| 4,298,005 | 11/1981 | Mutzhas | 250/504 R |
| 4,309,616 | 1/1982 | Wolff . | |
| 4,316,094 | 2/1982 | Wolff . | |
| 4,371,810 | 2/1983 | Corth | 313/487 |
| 4,420,709 | 12/1983 | Rattray | 313/486 |

FOREIGN PATENT DOCUMENTS

| | | | |
|---|---|---|---|
| 2128065 | 6/1972 | Fed. Rep. of Germany . | |
| 2455605 | 6/1975 | Fed. Rep. of Germany | 313/487 |
| 2707894 | 8/1978 | Fed. Rep. of Germany | 313/112 |
| 2841545 | 4/1979 | Fed. Rep. of Germany . | |
| 2826091 | 1/1980 | Fed. Rep. of Germany . | |
| 3022117 | 1/1981 | Fed. Rep. of Germany . | |
| 3032741 | 3/1981 | Fed. Rep. of Germany . | |
| 3121689 | 12/1982 | Fed. Rep. of Germany . | |
| 1577854 | 10/1980 | United Kingdom . | |

OTHER PUBLICATIONS

OSRAM catalogue, Apr. 1982.

*Primary Examiner*—Craig E. Church
*Assistant Examiner*—John C. Freeman
*Attorney, Agent, or Firm*—Peter K. Kontler

[57] ABSTRACT

A sunlamp whose cylindrical envelope contains a mixture of three substances the first of which emits radiation with pronounced peaks in the red, blue and green bands of the visible range of the spectrum, the second of which emits radiation with a less pronounced peak in the long-wave portion of the UVA band, and the third of which emits with an even less pronounced peak radiation in the short-wave portion of the UVA band and down to 300 nm in the UVB band. The lamp is photobiologically effective in the UV range and is sufficiently bright in the range of visible light.

15 Claims, 3 Drawing Figures

LAMP FOR EMISSION OF RADIATION IN UV AND VISIBLE LIGHT RANGES OF THE SPECTRUM

CROSS-REFERENCE TO RELATED CASES

A sunlamp which emits radiation primarily in the UVA band of the ultraviolet range and in the visible range of the spectrum is disclosed in the commonly owned copending patent application Ser. No. 752,251 filed July 3, 1985.

Reference should also be had to commonly owned U.S. Pat. Nos. 4,095,113, 4,106,083, 4,177,384, 4,194,125, 4,196,354, 4,287,554, 4,309,616 and 4,316,094.

BACKGROUND OF THE INVENTION

The invention relates to improvements in lamps, especially sunlamps, which emit radiation in the visible and ultraviolet ranges of the spectrum.

It is already known to fill the envelope of a sunlamp with a mixture of radiation emitting substances which ensure that the lamp can emit radiation in the visible as well as in the UVA band of the ultraviolet range of the spectrum. The effect of such lamps strongly resembles that of sunlight except that the lamps cannot radiate the same amount of heat energy. However, the addition of a substance which causes the lamp to radiate in the UVA band affects a pronounced reduction of radiation in the visible range, i.e., the brightness of such lamps is less than satisfactory.

It is also known to confine in the envelope of a lamp a substance which has pronounced radiation peaks in the red, blue and green portions of the visible range, i.e., in those portions of the visible range in which the human eye is particularly sensitive so that the lamp can be categorized as a "bright" lamp.

OBJECTS AND SUMMARY OF THE INVENTION

An object of the invention is to provide a lamp, particularly a sunlamp, whose brightness is highly satisfactory even though it is capable of emitting radiation in the visible as well as in the ultraviolet range of the spectrum.

Another object of the invention is to provide a lamp whose photobiological effect in the ultraviolet range is highly satisfactory in spite of the fact that it can be categorized as a "bright" lamp.

A further object of the invention is to provide a sunlamp which can be utilized for long periods of time without any adverse effects upon the person whose body is exposed to its radiation.

An additional object of the invention is to provide a novel and improved combination of radiation-emitting substances which can be utilized in a lamp of the above outlined character.

Another object of the invention is to provide novel and improved substances which can be utilized in the above outlined lamp to ensure the emission of beneficial radiation in the UVA and UVB bands of the ultraviolet range of the spectrum.

A further object of the invention is to provide a novel and improved ratio of radiation emitting substances which can be used in the above outlined lamp.

The invention is embodied in a lamp which emits radiation in the red, blue and green bands of the visible range as well as in the long-wave and short-wave portions of the UVA range of the spectrum. The energy maximum of radiation in the long-wave portion of the UVA range is less pronounced than the energy maxima in the red, blue and green bands of the visible range, and the energy maximum of radiation in the short-wave portion of the UVA range is substantially less pronounced than in the long-wave portion of the UVA range and extends into the UVB range to terminate in the region of approximately 300 nm.

The energy maximum of radiation in the long-wave portion of the UVA range is preferably between 370 and 390 nm.

The lamp comprises an envelope and a mixture (e.g., an internal layer) of radiation emitting substances in the envelope. The mixture includes a first substance which emits radiation in the visible range, a second substance which emits radiation in the longwave portion of the UVA range, and a third substance which emits radiation between 300 and at least 320 nm. The second substance can emit radiation between approximately 350 and 400 nm, and the third substance is preferably selected to emit radiation up to approximately and at least slightly above 350 nm. The percentage of the first substance is preferably at least 80 percent of the sum of the first, second and third substances; the percentage of the second substance preferably exceeds the percentage of the third substance and the second substance preferably contains europium-activated strontium fluoroborate; the third substance preferably contains cerium-strontium-magnesium aluminate; the second substance preferably constitutes between 5 and 10 percent of the sum of the first, second and third substances; and the third substance preferably constitutes between 1 and 4 percent of the sum of the first, second and third substances.

The novel features which are considered as characteristic of the invention are set forth in particular in the appended claims. The improved lamp itself, however, together with additional features and advantages thereof, will be best understood upon perusal of the following detailed description of certain specific embodiments with reference to the accompanying drawing.

DESCRIPTION OF THE PREFERRED EMBODIMENTS

Figure 1:
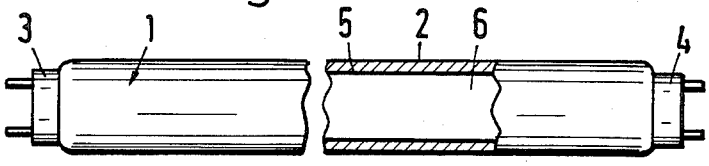
FIG. 1 is a partly elevational and partly axial sectional view of a lamp which embodies the invention.

The lamp 1 which is shown in FIG. 1 comprises a tubular (preferably cylindrical) envelope 2 which is made of glass and the end portions of which are provided with sockets 3 and 4. Each of the two sockets 3, 4 is provided with two outwardly extending terminal pins for attachment to a suitable energy source and with an internal electrode in a manner which is well known from the art of mercury-vapor lamps, sunlamps for tanning and the like. The internal surface of the envelope 2 is coated with a layer 5 of radiation-emitting material, and the space 6 within the layer 5 is filled with mercury vapors. The arrangement is such that, in the case of a low-pressure discharge, the dominant emission is at 254 nm. The layer 5 absorbs such radiation (which is located in the UVC band of the ultraviolet range of the spectrum) and fluoresces in the long-wave regions. The material of the envelope 2 is or can be filter glass which is capable of preventing emission of all or nearly all radiation below 300 nm.

Figure 2:
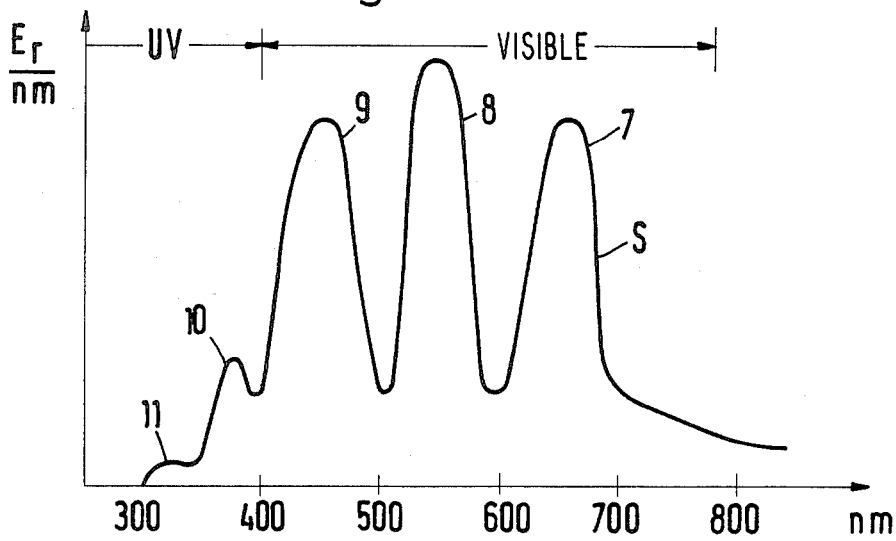
FIG. 2 is a diagram showing the distribution and intensities of radiation in the visible and ultraviolet ranges of the spectrum.
Figure 3:
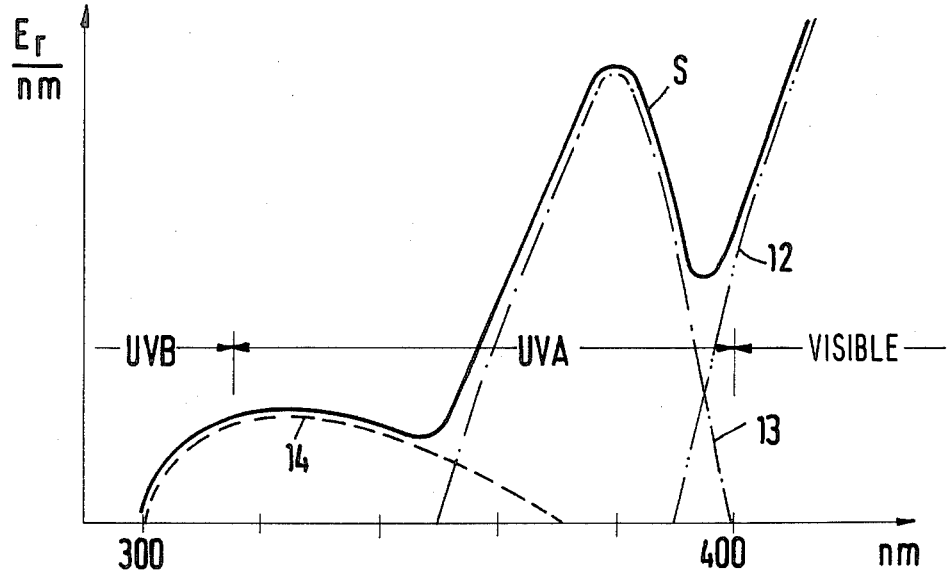
FIG. 3 is a larger-scale view of the distribution and intensities of radiation in the UVA and UVB bands of the ultraviolet range of the spectrum.

In accordance with a feature of the invention, the substances which constitute the radiation-emitting layer 5 are intermixed in such a way that the various energy maxima together form a curve S one portion of which is located in the ultraviolet range UV and another portion of which is located in the visible range of the spectrum. In the diagrams of FIGS. 2 and 3, the wavelength (in nm) is measured along the abscissa and the energy distribution $E_r$/nm in various bands of the ultraviolet and visible ranges of the spectrum is measured along the ordinate. FIG. 2 shows that the radiation in the visible range of the spectrum has three pronounced maxima or peaks 7, 8 and 9 in the red, green and blue bands of the visible range as well as a rather pronounced maximum or peak 10 in the long-wave portion of the UVA band of the ultraviolet range UV. The maximum of radiation in the long-wave portion of the UVA band is approximately 380 nm. The energy maximum at 10 is much less pronounced than that at 7, 8 and/or 9. Still further, the curve S exhibits a fifth maximum or peak 11 which is in the short-wave portion of the UVA band and extends into the adjacent portion of the UVB band. The peak 11 is much less pronounced than the peak 10 and terminates rather abruptly at approximately 300 nm.

The peaks 7, 8 and 9 conform to the light-sensitivity of the human eye, and the peak 10 is attuned to the functional curve of the recovery of the eye and to photorecovery of the cells. The formation of vitamin $D_3$ is attributable to the fact that the low-energy peak 11 of the curve S extends into the wavelength region between 300 and 320 nm. Furthermore, the peak 11 contributes to an escalation of energy and to activation of tissue change.

The curve S can be obtained with a layer 5 which contains a mixture of the following three substances: The first substance can be a three-band substance (which can also constitute a mixture of two or more substances) whose spectral distribution (denoted by the line 12 in the diagram of FIG. 3) begins at approximately 390 nm and extends across the major part at least of the visible spectrum. The second substance is denoted by the line 13 of FIG. 3 and emits between about 350 and 400 nm with a maximum preferably at 380 nm. The third substance is denoted by the line 14 of FIG. 3 and emits between approximately 300 and 370 nm. The configuration of the curve S is attributable to the superimposition of radiation by the three substances. The major percentage (preferably between approximately 86 and 94 percent) of the mixture of the three substances consists of the first substance. The second substance can constitute between 5 and 10 percent of the mixture of the three substances, and the third substance can constitute between 1 and 4 percent of such mixture.

In accordance with a presently preferred embodiment of the invention, the first substance is or can be identical with the three-band substance of a commercially available sunlamp, the second substance consists of or contains europium-activated strontinum fluoroborate, and the third substance consists of or contains cerium-strontium-magnesium aluminate. Other substances can be used with equal or similar advantage, as long as the curve which is representative of radiation maxima in the ultraviolet and visible ranges of the spectrum matches or sufficiently resembles the curve S to ensure that the lamp can meet the aforediscussed and hereinafter discussed objects of the invention.

As mentioned above, the wavelength and intensity of radiation of the improved lamp in the UV range of the spectrum are selected with a view to conform to the functional curves of the biological effect. Thus, the exposure of a person to radiation in the long-wave portion of the UV range entails a recovery of eventually damaged cells as well as recuperation of the eyes as a result of regeneration of rhodopsin which is bleached when the eyes are in use. The corresponding portion of the curve S extends between approximately 340 and 420 nm and its peak is at or close to 380 nm.

The body of a person who is exposed to radiation in the longer-wave portion of the UVB band and in the shorter-wave portion of the UVA band builds the vitamin $D_3$ which results in resorption of calcium, and such radiation leads to increased effectiveness of the muscles and circulatory organs as well as to more pronounced exchange of tissue and resulting increase of the percentage of oxygen in blood. The corresponding portion of the curve ends at 320 nm and it slopes rather pronouncedly toward the left-hand end, as viewed in FIG. 3.

The quantity of the third substance is relatively small and is preferably selected in such a way that the radiation which is emitted in the long-wave portion of the UVB band of the ultraviolet range cannot lead to erythema of the skin even after a long-lasting exposure (e.g., for a period of eight hours). This can be readily achieved because a very small amount of radiation in the long-wave portion of the UVB band suffices to achieve the aforediscussed photobiological functions and also because the maximum of the function curve which leads to development of erythema is below 300 nm, i.e., within a range wherein the radiation is absorbed by the material of the envelope 2 and/or wherein the mixture of the aforediscussed substances does not emit at all. The energy losses are negligible even if the mixture of substances emits in the range below 300 nm.

Since the radiation in the UV range of the spectrum is dependent on the functional curves of the biological effect, the quantity of the substance or substances which emit in the UV range is relatively small. Therefore, such substances do not appreciably affect radiation and radiation efficiency in the visible light range. However, and since the substance which is responsive for radiation in the visible range does not generate a continuous spectrum but emits only in the bands (at 7, 8 and 9) which are attuned to the sensitivity of the human eye, the brightness of the improved lamp is much more pronounced than that of conventional sunlamps (with a more or less uniform continuous spectrum in the visible range) in spite of the addition of substances which effect radiation in the UV range.

It has been found that the improved lamp is particularly effective if the energy maximum 10 of the curve S is between 370 and 390 nm. Such energy maximum corresponds substantially to the maximum of the function curve for the regeneration of cells and rhodopsin.

The ratio of substances which cause the radiation to exhibit the maxima 7 to 11 is selected with a view to ensure maximum beneficial effects with minimal quantities of such substances. As mentioned above, the second substance preferably emits between 350 and 400 nm, and the third substance preferably emits within a range which can begin at 300 and extends at least to but preferably beyond 350 nm. This entails a certain superimposition of the corresponding portions (10 and 11) of the curve S so that the functional values for photorecovery of the cells and for the recovery of the eyes (primarily between 340 and 380 nm) can be utilized all the way starting in the shortest-wavelength part of the corresponding portions of the curve.

The brightness of the improved lamp (in spite of a highly satisfactory effect in the UV range) is attributable to the relatively high ratio (more than 80 percent) of the first substance in the aforementioned mixture of the three substances.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A lamp, comprising an envelope; a gas in said envelope discharge means and for effecting a discharge; and a mixture of substances in said envelope for emitting radiation in response to a discharge, said mixture including a first substance which emits radiation having energy maxima in the red, blue and green bands of the visible range, a second substance which emits radiation having an energy maximum in the long-wave Portion of the UVA band, and a third substance which emits radiation in a part of the UV range extending from the short-wave portion of the UVA band down to approximately 300 nm in the long-wave portion of the UVB band, the third substance's radiation having an energy maximum in the short-wave portion of the UVA band the energy maximum of radiation in the long-wave portion of the UVA band lying between 370 and 390 nm and being less pronounced than the energy maxima in the red, blue and green bands of the visible range, and the energy maximum of radiation in the short-wave portion of the UVA band being substantially less pronounced than the energy maximum in the long-wave portion of the UVA band.

2. The lamp of claim 1, wherein said third substance emits radiation from 300 to at least 320 nm.

3. The lamp of claim 1, wherein said second substance emits radiation between approximately 350 and 400 nm.

4. The lamp of claim 2, wherein said third substance emits radiation up to approximately and at least slightly above 350 nm.

5. The lamp of claim 1, wherein the percentage of said first substance is at least 80 percent of the sum of said first, second and third substances.

6. The lamp of claim 1, wherein the percentage of said second substance exceeds the percentage of said third substance.

7. The lamp of claim 1, wherein said second substance contains europium-activated strontium fluoroborate.

8. The lamp of claim 1, wherein said third substance contains cerium-strontium-magnesium aluminate.

9. The lamp of claim 1, wherein said second substance constitutes between 5 and 10 percent of the sum of said first, second and third substances.

10. The lamp of claim 1, wherein said third substance constitutes between 1 and 4 percent of the sum of said first, second and third substances.

11. The lamp of claim 1, wherein the energy maximum of radiation in the long-wave portion of the UVA band is at approximately 380 nm.

12. The lamp of claim 1, wherein said first substance emits radiation in a range extending from about 390 nm across at least the major part of the visible spectrum.

13. The lamp of claim 1, wherein said gas has a low pressure so as to effect a low-pressure discharge.

14. The lamp of claim 4, wherein said third substance emits radiation up to approximately 370 nm.

15. The lamp of claim 5, wherein the percentage of said first substance is between about 86 and about 94 percent of the sum of said first, second and third substance.

* * * * *